United States Patent [19]

Chamberlain

[11] Patent Number: 4,474,012

[45] Date of Patent: Oct. 2, 1984

[54] STEAM TURBINE PRESSURE RATE LIMITER

[75] Inventor: Harvey H. Chamberlain, Marblehead, Mass.

[73] Assignee: General Electric Company, Lynn, Mass.

[21] Appl. No.: 513,468

[22] Filed: Jul. 13, 1983

[51] Int. Cl.[3] ..... F01K 13/02
[52] U.S. Cl. ..... 60/660; 60/646
[58] Field of Search ..... 60/660, 646, 657

[56] References Cited

U.S. PATENT DOCUMENTS 4,203,297 5/1980 Sakai et al. ..... 60/660
4,297,848 11/1981 Silvestri, Jr. ..... 60/667
4,412,780 11/1983 Collins et al. ..... 60/667

*Primary Examiner*—Allen M. Ostrager
*Attorney, Agent, or Firm*—James W. Mitchell

[57] ABSTRACT

A steam pressure rate limiter for a steam turbine system reduces the setting of a steam control valve when a rate of decrease in steam pressure is detected which exceeds a threshold value of rate of decrease. A floor on control of the steam control valve is enforced in order to maintain a predetermined amount of steam flow to the turbine thereby to provide for cooling of the turbine.

8 Claims, 4 Drawing Figures

STEAM TURBINE PRESSURE RATE LIMITER

BACKGROUND OF THE INVENTION

The present invention relates to steam turbines and, more particularly, to control systems for steam turbines. Even more particularly, the present invention relates to means for reducing the possibility of turbine damage resulting from water carryover from the boiler into the steam turbine.

Steam turbines are designed to operate with a supply of steam produced by a boiler. During certain phases of operation, there is a risk that water may enter the steam turbine along with the steam. Water carryover is undesirable since the resulting mechanical vibrations and thermal shock may result in shortened lifetime or immediate permanent damage to the steam turbine.

Water carryover may be produced, for example, by an excessive steam demand compared to the existing boiler generating capacity or the complement of this condition, an insufficient steam supply compared to the steam demand. Although these two conditions may be considered to be similar, they can be roughly differentiated according to their causes. Excessive steam demand can occur, for example, during startup when the rate of increase in the steam fed to the steam turbine exceeds the rate of increase in steam generation of the boiler. This mismatch results from the fact that, whereas a steam turbine is capable of responding quite rapidly to additional steam fed to it, the boiler, depending as it does on the less rapidly responding heat source, may not be able to increase its output at a corresponding rate. This is especially true of coal-fired boilers. An insufficient steam supply may occur, for example, due to a fire outage in the boiler, a problem in the boiler controller or an improperly chosen boiler setpoint.

During startup of a steam turbine driving an electric generator, for example, the steam turbine is manually or automatically brought up to running speed under no load or, at most, under light load. The electric generator is then energized and the torque output of the steam turbine is gradually increased by automatically or manually increasing the flow of steam fed to it. Ideally, the steam being generated should increase at the same rate as the steam flow. As noted above, however, and particularly in the case of a coal-fired boiler, the responses of the steam turbine and the boiler cannot be perfectly matched. Thus, during startup at least, the boiler pressure must be permitted to vary within limits. When the boiler pressure falls too low too rapidly, however, water carryover can occur.

One method for avoiding water carryover provides for manually or automatically reducing, or even cutting off, steam flow when the steam pressure decreases to a value lower than a fixed or variable threshold. The thresholding method may not be adequate during startup when the rate of change in boiler pressure can exceed the response capability of the steam valve control system. If the steam valve control system is additionally made responsive to the rate of change in steam pressure, a way is provided for predicting an impending condition of water carryover early enough for timely control of steam flow by the steam valve control system.

Although steam pressure rate control is attractive, certain problems require solutions. As is well known, steam turbines, particularly in electric utility service, remain in operation for uninterrupted times measured in months to years. In addition, although rapid pressure variations may occur at times, very slow pressure changes may also require tracking over such extended periods. Control devices for such service must therefore be stable and drift-free. Rate measuring devices of the prior art suffer from drift which makes them marginal at best for this use.

OBJECTS AND SUMMARY OF THE INVENTION

Accordingly, it is an object of the invention to provide a control system for a steam turbine which overcomes the drawbacks of the prior art.

It is a further object of the invention to provide a control system for a steam turbine which controls the steam fed to a steam turbine in response to a negative rate of change in boiler steam pressure.

It is a further object of the invention to provide a steam pressure rate limiter which tends to reduce the setting of a steam control valve in response to a negative rate of change in steam pressure exceeding a threshold value of negative rate of change. A floor circuit prevents fully closing the steam control valve in order to provide a predetermined minimum steam flow for cooling the turbine.

According to an embodiment of the invention, there is provided apparatus for limiting a maximum rate of pressure decrease in a steam turbine system of the type having a boiler, a steam control valve and a turbine comprising means for detecting a reduction in steam pressure in the boiler at a rate exceeding a predetermined threshold value, means for reducing a setting of the steam control valve in response to the means for detecting and means for preventing the means for reducing from reducing the setting of the steam control valve to a completely cutoff condition whereby at least a minimum flow of steam to said turbine is maintained.

According to a feature of the invention, there is provided a method for limiting a maximum rate of pressure decrease in a steam turbine system of the type having a boiler, a steam control valve and a turbine comprising detecting a reduction in steam pressure in the boiler at a rate exceeding a predetermined threshold value, reducing a setting of the steam control valve in response to the rate exceeding the threshold value and preventing the reducing from reducing the setting of the steam control valve to a completely cutoff condition whereby at least a minimum flow of steam to the turbine is maintained.

Briefly stated, the present invention provides a steam pressure rate limiter for a steam turbine control system which reduces the setting of a steam control valve when a rate of decrease in steam pressure is detected which exceeds a threshold valve of rate of decrease. A floor on control of the steam control valve is enforced in order to maintain a predetermined amount of steam flow to the turbine in order to provide for cooling of the turbine.

The above, and other objects, features and advantages of the present invention will become apparent from the following description read in conjunction with the accompanying drawings, in which like reference numerals designate the same elements.

BRIEF DESCRIPTION OF THE PREFERRED EMBODIMENT

Figure 1:
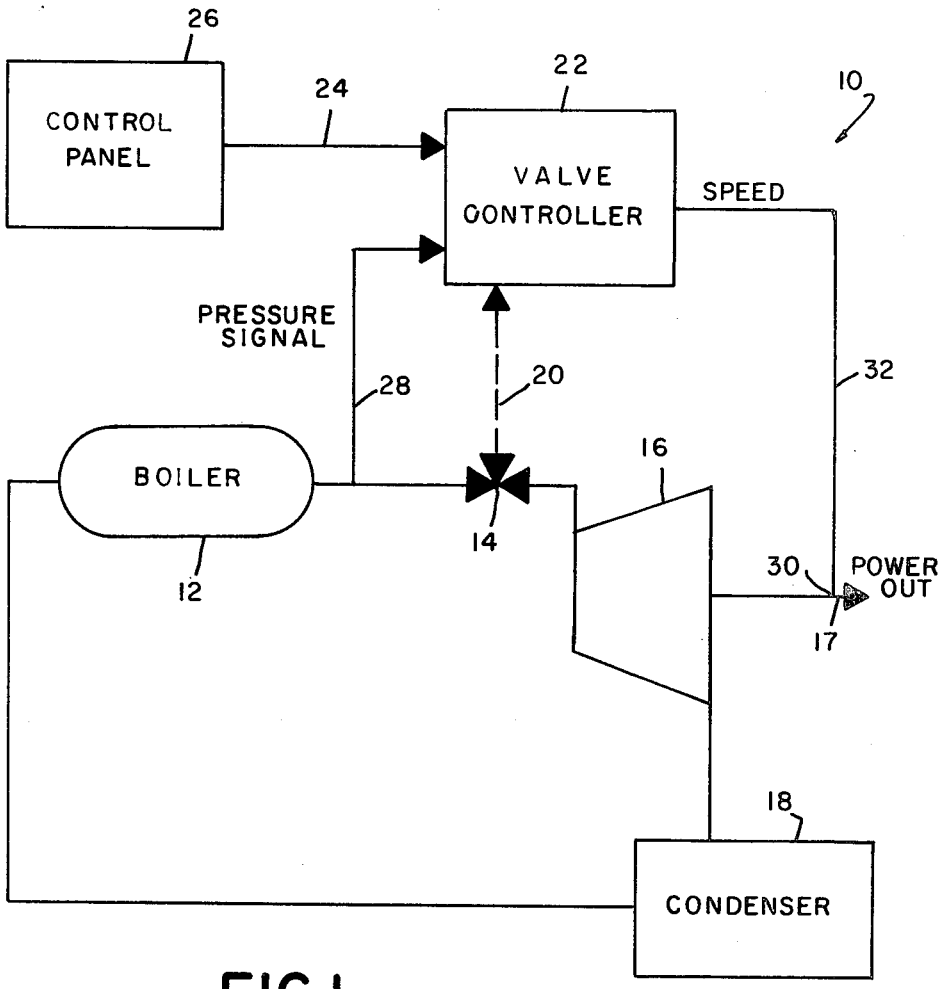
FIG. 1 is a simplified block diagram of a steam turbine and its control system to which reference will be made in describing the present invention.

Referring to FIG. 1, there is shown, generally at 10, a steam turbine system to which the present invention may be applied. Steam turbine system 10 includes a conventional boiler 12 in which water is heated, and preferably superheated, before application through a steam control valve 14 to a turbine 16. Turbine 16 produces an output on a shaft 17. As is conventional, boiler 12 includes a fuel supply and combustion system (not shown) for delivering and burning conventional fuel such as, for example, fuel oil or coal to produce the steam.

After the steam has given up a substantial part of its thermal energy by expansion in turbine 16, it is condensed to liquid water in a condenser 18. The liquid water is returned to boiler 12 for further cycling in the system.

Steam control valve 14 is a servo controlled valve whose condition of openness or closedness is controlled by a mechanical input, indicated by a dashed line 20, from a valve controller 22.

In operation, manually generated or automatically generated signals in control panel 26, applied to valve controller 22 on control lines 24, select the desired speed of shaft 17 and the torque output which may be applied on shaft 17 to, for example, a conventional electric generator (not shown).

Figure 2:
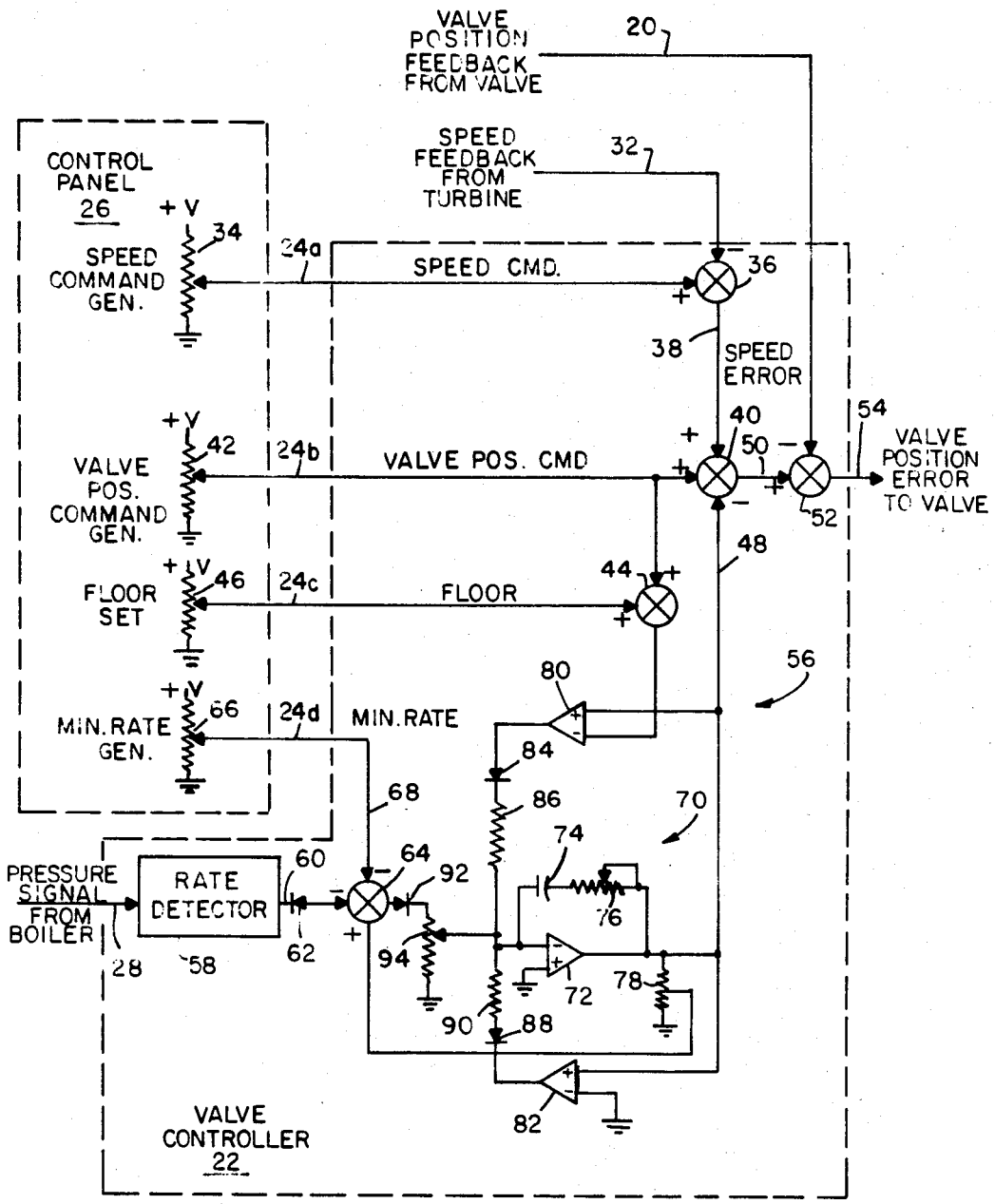
FIG. 2 is a detailed block and schematic diagram of a control panel and a valve controller of FIG. 1.

Pertinent parts of control panel 26 and valve controller 22 are shown in FIG. 2 to which reference is now made. Control panel 26 provides means for generating the control signals used by valve controller 22 and elsewhere in steam turbine system 10. These means may take any conventional form including electromechanically programmed devices, remotely controlled devices or computer devices. Their control signals may be analog DC or AC signals or they may be digital signals. For present purposes, control panel 26 is shown to contain variable resistors, which may be, for example, manually adjusted, operating as DC voltage dividers for generating DC control signals.

A speed command variable resistor 34 produces a speed command signal which is fed on a line **24*a* to a plus input of an adder 36 in a valve controller 22. The speed feedback or tachometer signal on line 32 is fed to a minus input of adder 36. The difference between the commanded speed and the measured speed is a speed error signal which is fed on a line 38 to a plus input of an adder 40. A valve position command variable resistor 42 produces a valve position command signal which is fed on a line 24*b* to a plus input of adder 40 and to a plus input of adder 44. A floor set variable resistor 46 produces a floor signal which is fed on a line 24*c* to a plus input of adder 44. A signal related to an excess rate of decrease in steam pressure is fed on a line 48 to a minus input of adder 40**.

The output of adder 40, representing a desired valve position, is fed on a line 50 to a plus input of an adder 52. The valve position feedback signal of line 20 is fed to a minus input of adder 52. The output of adder 52 is a valve position error signal which is fed on a line 54 to a conventional servo controller for steam control valve 14 (FIG. 1).

Normally a steam turbine, particularly in electric utility service, operates precisely at, or very close to, its commanded speed. Thus, the normal speed error signal fed from adder 36 to adder 40 is zero. In addition, under normal operation the steam pressure does not decrease at a rate which produces a signal on line 48. Thus the signal on line 48 is normally zero. The output of adder 40 is therefore normally directly responsive to the valve position command fed to it on line **24*b*. The opening and closing of steam control valve 14** is thus normally directly responsive to the difference between the valve position command and the valve position feedback signal. The valve position, to a first approximation, determines the output power of the steam turbine. Thus, the above difference controls the output power.

A pressure rate monitoring circuit, shown generally at 56, monitors the steam pressure for the occurrence of an excessive rate of decrease and, if such excessive rate of decrease should be detected, produces the signal on line 48 effective for at least partially closing steam control valve 14. Pressure rate monitoring circuit 56 includes a rate detector 58, to be more fully described hereinafter, which monitors the pressure signal on line 28 and, if such pressure rate exceeds a threshold value, produces an output signal on a line 60 which is proportional to the amount by which the rate exceeds the threshold. Since only negative changes in steam pressure are of interest, a diode 62 is provided, properly poled to pass the signals of a polarity produced by excessively falling steam pressure and to block signals of the opposite polarity. The rate signal on line 60 is applied to a minus input of an adder 64.

A minimum rate variable resistor 66 in control panel 26 produces a minimum rate signal which is applied on a line 68 to a minus input of adder 64. A shaping circuit, shown generally at 70, includes an operational amplifier 72 which includes a large-value integrating capacitor 74 in series with a variable resistor 76 in the feedback path between its output and its negative input. A variable resistor 78 feeds a portion of the output of operational amplifier 72 back to a plus input of adder 64. The output of operational amplifier 72, which is the excess steam pressure rate signal on line 48, is also fed to plus inputs of upper limit comparator 80 and lower limit comparator 82. The minus input of upper limit comparator 80 receives the output of adder 44. The minus input of lower limit comparator 82 is grounded. The output of upper limit comparator 80 is fed through the anode-cathode path of a diode 84 and a resistor 86 to the input of operational amplifier 72. Similarly, the output of lower limit comparator 82 is fed through the cathode-anode path of a diode 88 and a resistor 90 to the input of operational amplifier 72. The output of adder 64 is fed through the anode-cathode path of a diode 92 to a variable resistor 94. A portion of the voltage fed to variable resistor 94 is applied therefrom to the input of operational amplifier 72.

The minimum rate signal on line 68, subtracted from the remaining signals in adder 64, is introduced to permit ignoring pressure rate disturbances which give rise to pressure rate signals which are too small to be permitted to cause a correction. Minimum rate variable resistor 66, thus provides externally adjustable bias on the rate threshold.

Figure 3:
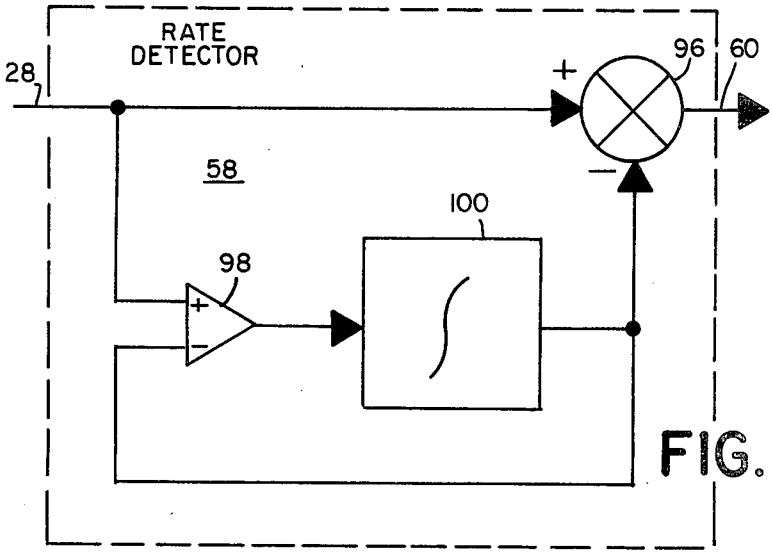
FIG. 3 is a simplified block diagram of a rate detector of FIG. 2.

Referring now to FIG. 3, a simplified block diagram is shown of one embodiment of rate detector 58. The pressure signal on line 28 is applied to a plus input of an adder 96 and to the plus input of a comparator 98. An integrator 100 receives the output of comparator 98, linearly integrates its input, and applies its output to minus inputs of adder 96 and comparator 98. Comparator 98 is of a conventional type which produces a fixed positive voltage output whenever the voltage at its plus input exceeds the voltage at its minus input and produces a fixed negative voltage output whenever the voltage at its plus input is less than the voltage at its minus input. Thus integrator 100 is forced to integrate at a fixed rate upward or downward until its output exactly equals the pressure signal on line 28. If the fixed rate at which integrator 100 is capable of integrating is faster than the rate of increase or decrease in the steam pressure signal, the output of integrator 100 is capable of exactly tracking the pressure signal and the result of the differencing process in adder 96 produces a zero output on line 60. If the rate of steam pressure change (and particularly of steam pressure decrease of interest) exceeds the rate at which integrator 100 is capable of integrating, the output of integrator 100 no longer tracks its input and therefor the difference from adder 96 is no longer zero but a finite value proportional to the amount by which the time integral of the steam pressure rate of change exceeds the threshold rate of change established by the fixed integration rate of integrator 100.

Figure 4:
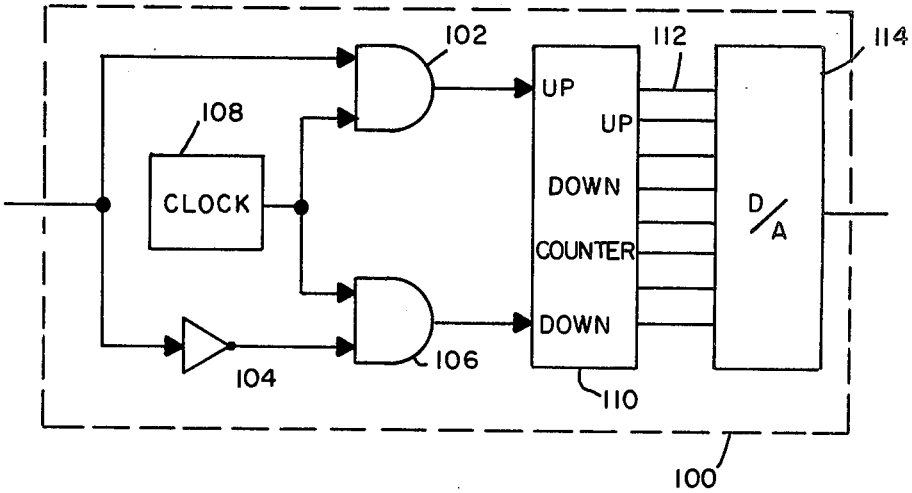
FIG. 4 is a detailed logic diagram of an integrator of FIG. 3.

Integrator 100 may take any convenient form such as analog or digital, however in the preferred embodiment, integrator 100 is a digital device which may take the exemplary embodiment shown in FIG. 4 to which reference is now made. The fixed-value positive or negative input signal is applied directly to one input of an AND gate 102 and through an inverter 104 to an input of an AND gate 106. A clock 108 produces output pulses at a fixed frequency which are applied to second inputs of AND gate 102 and AND gate 106. The output of AND gate 102 is applied to an up input of an up-down counter 110. The output of AND gate 106 is applied to the down input of up-down counter 110. All bits of the number or value contained in up-down counter 110 at any time are communicated in parallel on a plurality of lines 112 to inputs of a digital-to-analog converter. Digital-to-analog converter 114 produces a varying DC output voltage which is proportional to the digital value at its inputs.

The frequency of the output pulses of clock 108 may be adjusted upward or downward to thereby change the threshold of the steam pressure rate of change which provides an output signal.

Referring again to FIG. 2, the operation of pressure rate monitoring circuit 56 is described. When the internal rate threshold in rate detector 58 is exceeded in the negative direction, the resulting negative signal applied to adder 64 tends to drive its output positive. The positive minimum rate signal on line 68 prevents the output of adder 64 from going positive until the rate signal exceeds this threshold signal.

In the absence of shaping circuit 70, upper limit comparator 80 and lower limit comparator 82, the output of adder 64 would be connected directly on line 48 to the minus input of adder 40 where it would produce a signal effective to proportionately close steam control valve 14. The presence of shaping circuit 70 permits controlling the DC gain of the signal fed to adder 40 using variable resistor 78. In addition, if a very rapid, or step, transient in stream pressure should take place, it would be undesirable to apply such a transient signal to steam control valve 14. Accordingly, the integrating elements, capacitor 74 and variable resistor 76 in the feedback path of operational amplifier 72 as well as variable resistor 94 permit control of the integration or smoothing of the control signal before it is effective to control steam control valve 14.

For cooling purposes, it is desirable to maintain at least a minimum amount of steam flow through turbine 16. In the absence of means to prevent it, a rapidly falling steam pressure, occurring when the valve position command on line **24*b* is relatively low, could completely close steam control valve 14 without maintaining the required minimum cooling steam flow. Adder 44 and upper limit comparator 80 prevents this from occuring. The valve position command may vary from about zero to a positive value +V. However, the positive floor signal fed to adder 44 prevents the output of adder 44 from falling below the value of the floor signal even when the valve position command signal is decreased to approximately zero. When the output of operational amplifier 72 attempts to fall below the output of adder 44, the output of upper limit comparator 80 changes from high to low. This prevents further increase in the signal on line 48 tending to close steam control valve 14**.

Lower limit comparator 82 prevents the output of operational amplifier 72 from going negative which would have the effect of tending to open steam control valve 14 further than commanded by the valve position command. When the output of operational amplifier 72 attempts to go negative, the output of lower limit comparator 82 changes from high to low thus tending to drive the input of operational amplifier 72 in a direction which increases its output voltage to zero or above.

Having described preferred embodiments of the invention with reference to the accompanying drawings, it is to be understood that the invention is not limited to those precise embodiments, and that various changes and modifications may be effected therein by one skilled in the art without departing from the scope of the invention as defined in the appended claims.

What is claimed is:

1. Apparatus for limiting a maximum rate of pressure decrease in a steam turbine system of the type having a boiler, a steam control valve and a turbine comprising:

a digital integrator including a clock effective to produce a clock signal having a predetermined frequency, an up-down counter, and gating means, said gating means being effective to feed said predetermined frequency to said up-down counter in a first sense to produce one of counting up and counting down when said output of said integrator exceeds a signal related to said steam pressure and being further effective to feed said predetermined frequency to said up-down counter in a second sense to produce the other of counting up and counting down when said output of said integrator is less than said signal related to said steam pressure whereby a count is stored in said up-down counter; and means for reducing a setting of said steam control valve in proportion to an amount by which said count in said up-down counter differs from said signal related to said steam pressure.

2. Apparatus for limiting a maximum rate of pressure decrease in a steam turbine system according to claim 1 wherein said predetermined clock frequency is effective to establish a maximum integration rate, said maximum integration rate being effective to establish said maximum rate of pressure decrease.

3. Apparatus for limiting a maximum rate of pressure decrease in a steam turbine system according to claim 2 wherein said gating means includes means for differencing an output of said integrator and a signal related to said steam pressure, an output of said means for differencing being substantially zero when said rate is less than a predetermined value and related to the amount by which said rate exceeds said predetermined rate when said rate exceeds said predetermined rate.

4. Apparatus for limiting a maximum rate of pressure decrease in a steam turbine system according to claim 3 wherein said means for reducing a setting includes means for preventing setting said steam control valve to a completely cutoff condition whereby at least a minimum flow of steam to said steam turbine is maintained.

5. Apparatus for limiting a maximum rate of pressure decrease in a steam turbine system according to claim 3 wherein said means for preventing includes means for generating a floor signal related to at least a desired minimum position of said steam control valve and means for limiting an output of said means for reducing in response to said floor signal.

6. Apparatus for limiting a maximum rate of pressure decrease in a steam turbine system according to claim 5 wherein said means for generating a floor signal is further responsive to a valve position command signal for producing said floor signal.

7. Apparatus for limiting a maximum rate of pressure decrease in a steam turbine system according to claim 1 wherein said means for reducing a setting includes means for differencing a valve position command signal and a signal from said digital integrator to produce a desired valve position.

8. A method for limiting a maximum rate of pressure decrease in a steam turbine system of the type having a boiler, a steam control valve and a turbine comprising:

counting pulses of a clock at a predetermined frequency in an up-down counter in a first direction when said pressure exceeds a count in said up-down counter and in a second direction when said pressure is less than said count;

differencing said count and said pressure to produce a pressure rate signal, said predetermined frequency providing a threshold value of rate of steam pressure change which must exist to produce said pressure rate signal; and reducing a setting of said steam control valve in response to said pressure rate signal.

* * * * *